US008385575B2

(12) United States Patent
Kuo

(10) Patent No.: US 8,385,575 B2
(45) Date of Patent: Feb. 26, 2013

(54) REFLEX ENCLOSURE

(75) Inventor: Tsung-Cheng Kuo, Yangmei (TW)

(73) Assignees: Shu-Fang Hu, Taipei (TW);
Tsung-Cheng Kuo, Yangmei (TW);
Ching-Fan Cheng, Taipei (TW)

( * ) Notice: Subject to any disclaimer, the term of this patent is extended or adjusted under 35 U.S.C. 154(b) by 93 days.

(21) Appl. No.: 13/170,389

(22) Filed: Jun. 28, 2011

(65) Prior Publication Data

US 2013/0004008 A1 Jan. 3, 2013

(51) Int. Cl.
*H04R 25/00* (2006.01)

(52) U.S. Cl. ..... 381/349; 381/337; 381/338

(58) Field of Classification Search ..... 381/337, 381/338, 339, 345, 346, 348, 349, 351, 352, 381/160; 181/155, 156, 160, 194, 199
See application file for complete search history.

(56) References Cited

U.S. PATENT DOCUMENTS

| | | | | |
|---|---|---|---|---|
| 6,634,455 | B1 * | 10/2003 | Yang | 181/156 |
| 7,426,280 | B2 * | 9/2008 | Aylward | 381/338 |
| 7,436,972 | B2 * | 10/2008 | Bouvier | 381/345 |
| 2005/0195987 | A1 | 9/2005 | Kim | |
| 2008/0169150 | A1 | 7/2008 | Kuo | |

* cited by examiner

*Primary Examiner* — Huyen D Le

(57) ABSTRACT

A reflex enclosure, includes an enclosure body, a loudspeaker, a waveguide portion and a vibration unit; a rearward sound wave generated from the loudspeaker is guided 360 degree (in all directions) from the outside of the waveguide portion to the inside of the waveguide portion, and then push the vibration unit to generate vibration to generate a corresponding sound wave, thereby reducing a standing wave ratio of the rearward sound wave in a sound room to obtain a better timbre. Furthermore, the length of a rearward sound wave guiding distance can be extended, allowing the sound wave to have the effect of extending toward a low frequency compass. In addition, the rearward sound wave is allowed to compress to increase a vibration unit pushing force, thereby obtaining a better sound effect.

19 Claims, 4 Drawing Sheets

REFLEX ENCLOSURE

BACKGROUND OF THE INVENTION

1. Field of the Invention

The present invention relates to an enclosure of a sound device, and more particularly to a reflex enclosure capable of strengthening a bass effect.

2. Description of Related Art

U.S. Publishing Patent No. 20050195987 discloses an acoustic system, comprising: an enclosure, a waveguide section and at least two loudspeakers, where the two loudspeakers are substantially identical to each other and acoustically coupled to the enclosure, and respectively generate one forward sound wave and one rearward sound wave. The waveguide section is arranged in the enclosure and acoustically coupled to the two loudspeakers, conducts the rearward sound waves of the loudspeakers to one sound outlet, thereby strengthening a bass effect.

U.S. publishing Patent No. 20080169150 discloses a reflection-type sound box, comprising a box body and a loudspeaker. The box body comprises an upper shell and a lower shell defining a sound chamber jointly. The sound chamber has a reflection duct extended inward from the upper shell and a sound cup extended inward from the lower shell. The sound cup covers the outside of the reflection duct, and the sound cup and the reflection duct are spaced by a predetermined distance. The loudspeaker has an opening facing outward and is mounted in the box body and used for generating sounds.

The enclosure and the sound box respectively disclosed in the above-mentioned patents, both have a sound outlet, and utilize a waveguide structure to conduct the rearward sound wave of a loudspeaker to the sound outlet, but they cannot utilize the thrust of the reward sound wave of the loudspeaker to strengthen further a sound effect of the enclosure (sound box).

SUMMARY OF THE INVENTION

To improve a conventional reflex enclosure, and obtain a better sound effect, the present invention is proposed.

The main object of the present invention is to provide a reflex enclosure, including an enclosure body, a loudspeaker, a waveguide portion and a vibration unit, where a rearward sound wave generated from the loudspeaker is guided by the waveguide portion to push the vibration unit to generate a vibration and corresponding sounds, thereby obtaining a better bass effect.

Another object of the present invention is to provide a reflex enclosure, allowing a rearward sound wave generated from the loudspeaker is guided 360 degrees (in all directions) from the outside of the waveguide portion into the inside of the waveguide portion in a sound room, capable of reducing the standing wave ratio of the rearward sound wave in the sound room, thereby obtaining a better sound quality, and extending the length of a sound wave guiding distance, causing the sound wave to have an effect of extending toward s low frequency compass, and the rearward sound wave to be compressed to increase a thrust acted on the vibration unit so as to obtain a better sound effect.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
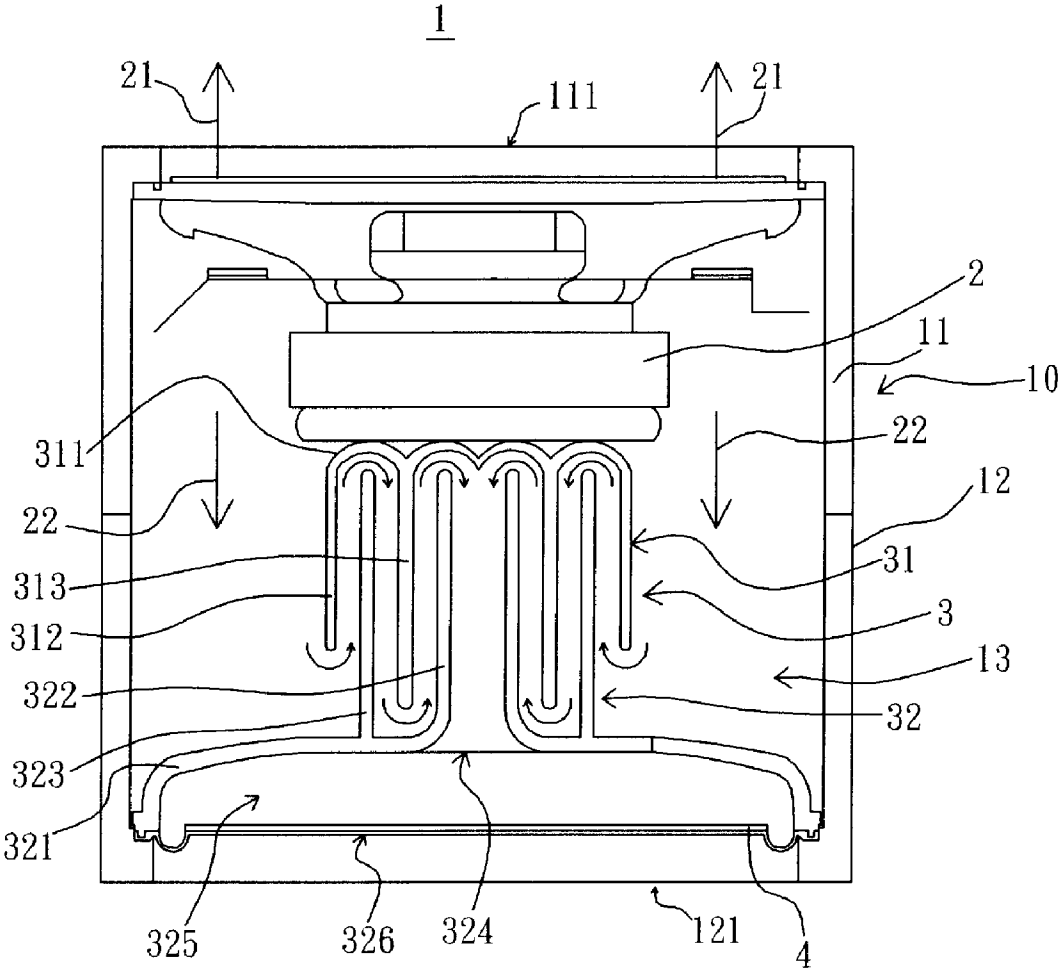
FIG. 1 is a schematic view of a reflex enclosure of a first preferred embodiment according to the present invention.
Figure 2:
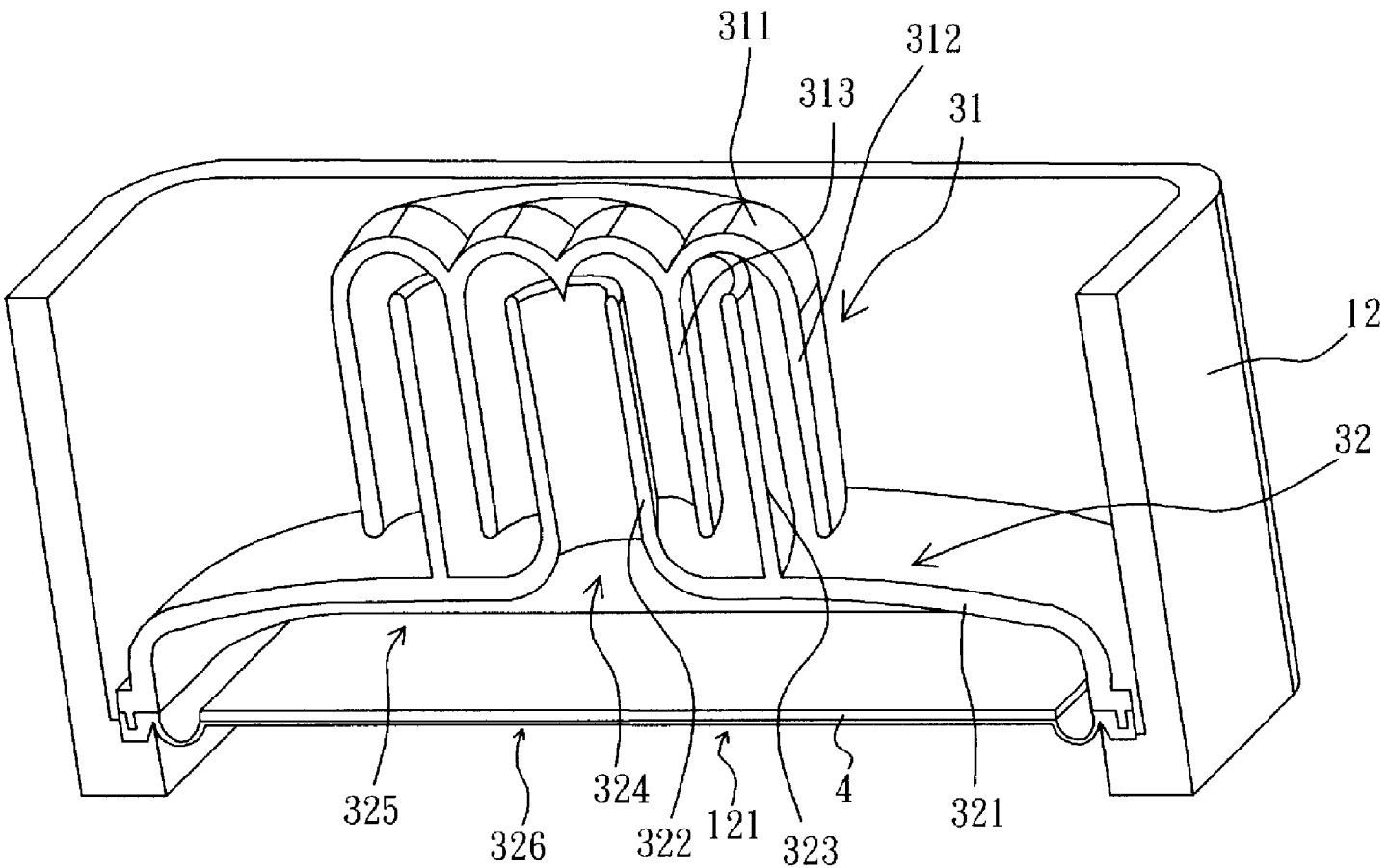
FIG. 2 is a schematic view of a waveguide portion of the first embodiment according to the present invention.

Referring to FIGS. 1 and 2, a reflex enclosure 1 of a first preferred embodiment according to the present invention includes an enclosure body 10, a loudspeaker 2, a waveguide portion 3 and a vibration unit 4.

The enclosure body 10 is constituted by a first shell body 11 and a second shell body 12. The first shell body 11 and the second shell body 12 are respectively disposed with a first sound outlet 111 and a second sound outlet 121. A hermetically sealed sound room 13 is formed inside the enclosure body 10 by combining the enclosure body 10 with the loudspeaker 2, the waveguide portion 3 and the vibration unit 4.

The loudspeaker 2 is coupled to the first shell body 11 at a position thereof adjacent to the first sound outlet 111. The loudspeaker 2 generates a forward sound wave in a direction as an arrow 21 shows and a rearward sound wave in a direction as an arrow 22 shows. The forward sound cave generated from the loudspeaker 2 may propagate to the outside of the first shell body 11 via the first sound outlet 111, and the rearward sound wave propagates in the sound room 13.

The waveguide portion 3 is constituted by a first waveguide element 31 and a second waveguide element 32. The first waveguide element 31 is constituted by a first bottom wall 311, a first surrounding wall 312 and a third surrounding wall 313. One end of the first surrounding wall 312 and one end of the third surrounding wall 313 are respectively coupled to the first bottom wall 311. The second waveguide element 32 is constituted by a second bottom wall 321, a second surrounding wall 322 and a fourth surrounding wall 323, and one end of the second surrounding wall 322 and one end of the fourth surrounding wall 323 are respectively coupled to the second bottom wall 321. A through hole 324 communicating with the inside of the second surrounding wall 322 is disposed in the middle of the second bottom wall 321. The diameter of the second surrounding wall 322 is smaller than the third surrounding wall 313. The diameter of the fourth surrounding wall 323 is smaller than the first surrounding wall 312 but larger than the third surrounding wall 313. The third surrounding wall 313, the fourth surrounding wall 323 and the first surrounding wall 312 are equidistantly disposed at the periphery of the second surrounding wall 322. Another end of the first surrounding wall 312 and another end of the third surrounding wall 313 are not in touch with the second bottom wall 321, and another end of the second surrounding wall 322 and another end of the fourth surrounding wall 323 are not in touch with the first bottom wall 311.

The positions of the first bottom wall 311 adjacent to the second surrounding 322 and the fourth surrounding wall 323 respectively have a curved shape projected toward the first sound outlet 111. The first bottom wall 311 is coupled to the loudspeaker 2 or coupled to the enclosure body 10 through a bracket (not shown in the figures). The second bottom wall 321 is disposed with a horn-shaped resonance chamber 325 and an opening 326. The resonance chamber 323 respectively communicates with the through hole 324 and the opening 326.

The vibration unit 4 is coupled to the second bottom wall 321 shielding the opening 326 and adjacent to the second sound outlet 121. The second bottom wall 321 is coupled to the second shell body 12 at a place thereof adjacent to the second sound outlet 121.

The rearward sound wave generated from the loudspeaker 2 in the sound room 13 is guided 360 degrees (in all directions) from the outside of the waveguide portion 3 to the inside of thereof, bypassing the first surrounding wall 312, fourth surrounding wall 323, third surrounding wall 313 and second surrounding wall 322 in sequence to propagate to the inside of the second surrounding wall 322. Thereafter, the reward sound wave passes through the through hole 324 and the resonance chamber 325 in sequence to push the vibration unit 4 to vibrate to generate a corresponding sound wave, and then the corresponding sound wave propagate to the outside of the second shell body 12 through the second sound outlet 121.

In the present embodiment, the design of arranging the loudspeaker 2 and the waveguide portion 3 in a column is suitable for an enclosure body with a long length and shallow width.

Figure 3:
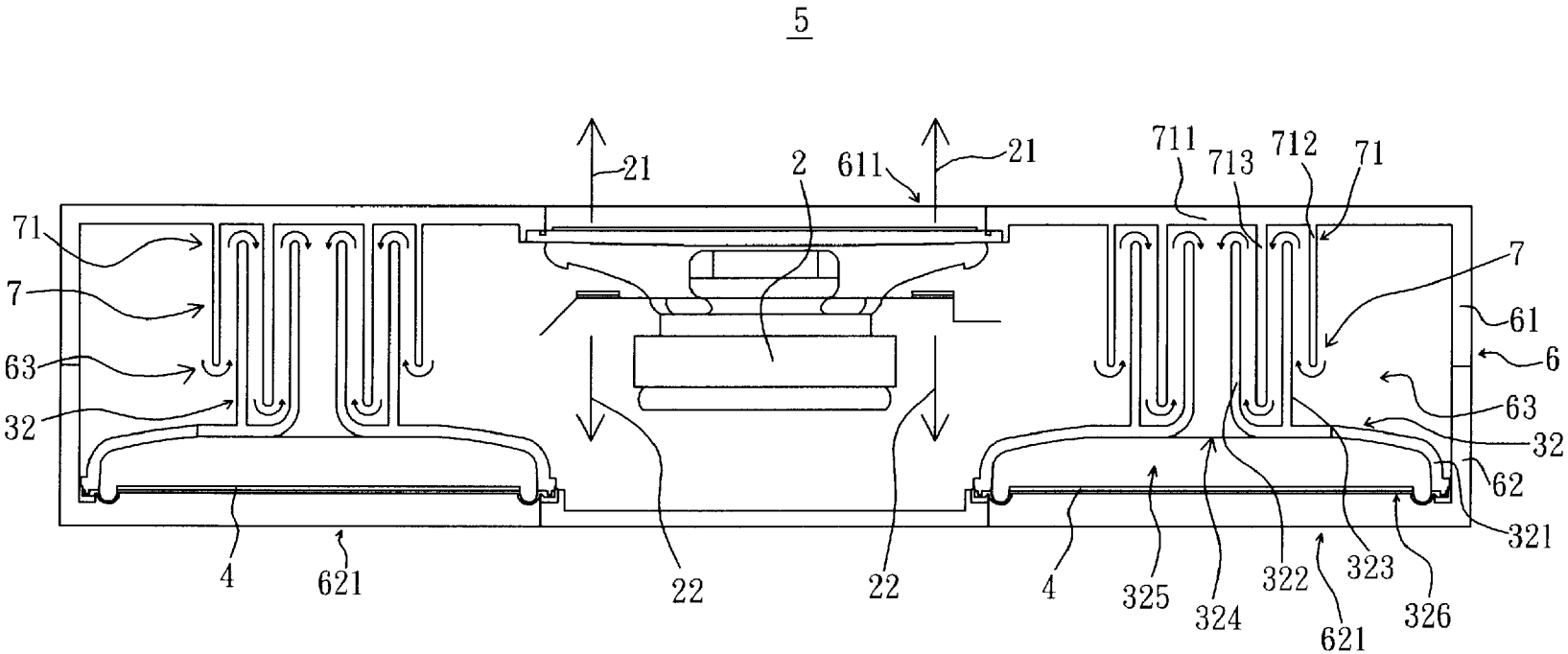
FIG. 3 is a schematic view of a reflex enclosure of a second preferred embodiment according to the present invention.
Figure 4:
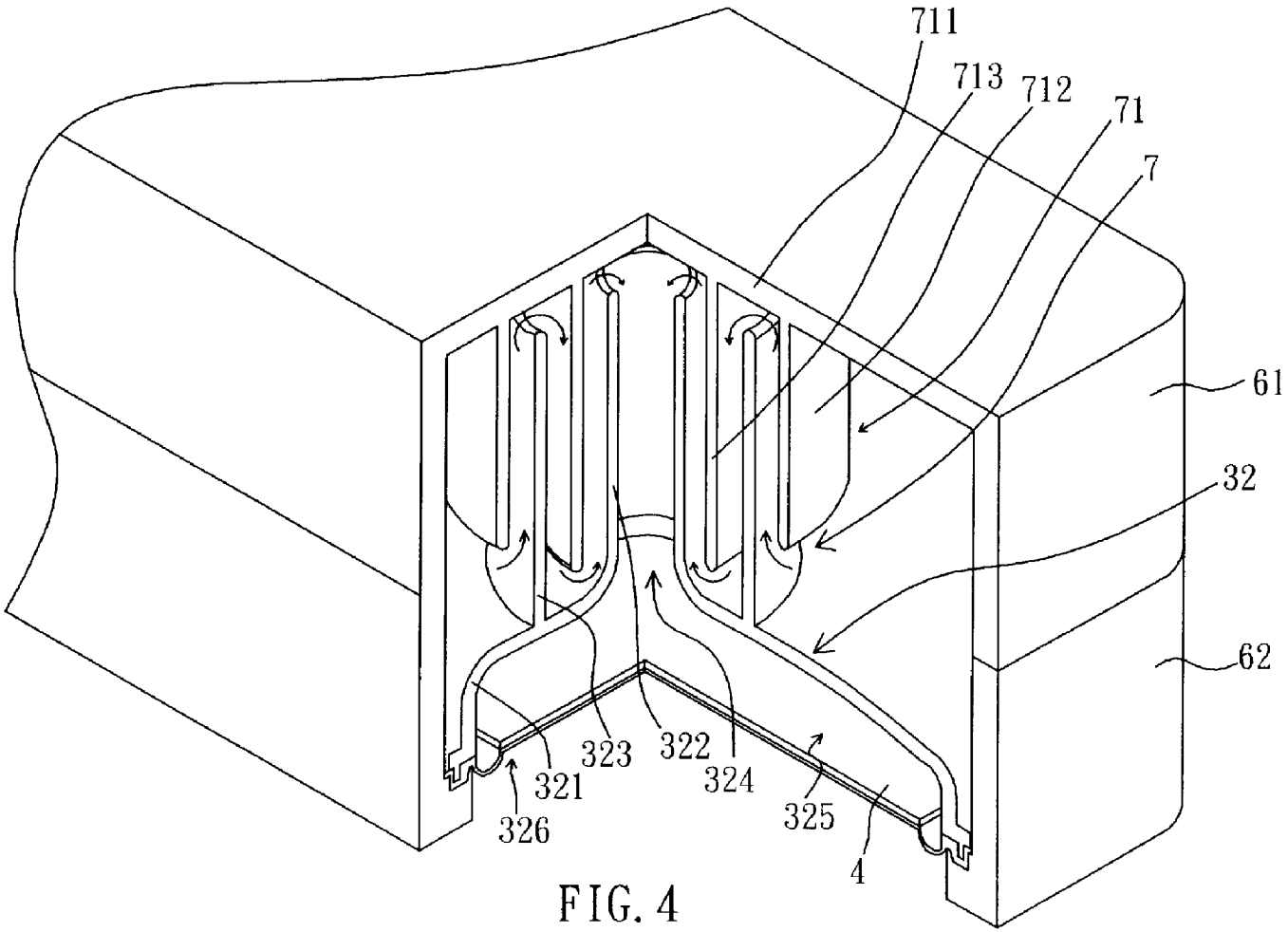
FIG. 4 is a schematic view of a waveguide portion of the second embodiment according to the present invention.

Referring to FIGS. 3 and 4, a reflex enclosure 5 of a second preferred embodiment according to the present invention, includes an enclosure body 6, a loudspeaker 2, two waveguide portions 7 and two vibration units 4.

The enclosure body 10 is constituted by a first shell body 61 and a second shell body 62. The first shell body 61 is disposed with a first sound outlet 611 and the second shell body 62 is disposed with two second sound outlets 621. A hermetically sealed sound room 63 is formed inside the enclosure body 6 by combining the enclosure body 6 with the two loudspeakers 2, the two waveguide portions 7 and the two vibration units 4.

The loudspeaker 2 is coupled to the first shell body 61 at a position thereof adjacent to the first sound outlet 611. The loudspeaker 2 generates a forward sound wave in a direction as an arrow 21 shows and a rearward sound wave in a direction as an arrow 22 shows. The forward sound wave generated from the loudspeaker 2 may propagate to the outside of the first shell body 61 via the first sound outlet 611, and the rearward sound wave propagates in the sound room 63.

The waveguide portion 7 is constituted by the first waveguide element 71 and the second waveguide element 32. The first waveguide element 71 is constituted by a first bottom wall 711, a first surrounding wall 712 and a third surrounding wall 713. One end of the first surrounding wall 712 and one end of the third surrounding wall 713 are respectively coupled to the first bottom wall 711. The first waveguide element 71 is integrated with the first shell body 61. Besides, the first waveguide element 71 may also be coupled to the first shell body 61. The structure of the second waveguide element 32 is the same as the one described in the first embodiment mentioned above. The diameter of the second surrounding wall 322 is smaller than the third surrounding wall 713. The diameter of the fourth surrounding wall 323 is smaller than the first surrounding wall 712 but larger than the third surrounding wall 713. The third surrounding wall 713, the fourth surrounding wall 323 and the first surrounding wall 712 are equidistantly disposed at the periphery of the second surrounding wall 322. Another end of the first surrounding wall 712 and another end of the third surrounding wall 713 are not in touch with the second bottom wall 321, and another end of the second surrounding wall 322 and another end of the fourth surrounding wall 323 are not in touch with the first bottom wall 711.

The positions of the first bottom wall 711 adjacent to the second surrounding wall 322 and the fourth surrounding wall 323 may respectively also have a curved shape projected toward the first sound outlet 611 in the present embodiment.

The coupling structure of the vibration unit 4 to the second bottom wall 321 is the same as the one described in the first embodiment mentioned above. The second bottom wall 321 is coupled to a position of the second shell body 62 adjacent to the second sound outlet 621.

The rearward sound wave generated from the loudspeaker 2 in the sound room 63 is guided 360 degrees (in all directions) from the outside of the waveguide portion 7 to the inside of thereof, bypassing the first surrounding wall 712, fourth surrounding wall 323, third surrounding wall 713 and second surrounding wall 322 in sequence to propagate to the inside of the second surrounding wall 322. Thereafter, the rearward sound wave passes through the through hole 324 and the resonance chamber 325 in sequence to push the vibration unit 4 to vibrate to generate a corresponding sound wave, and then the corresponding sound wave propagate to the outside of the second shell body 62 through the second sound outlet 621.

In the present embodiment, the equidistant installment of the loudspeaker 2 from the two waveguide portions 7 is suitable for an enclosure body with a short length and wide width.

The reflex enclosure of the present invention allows the waveguide portion to be further coupled to the vibration unit; the rearward sound wave generated from the loudspeaker pushes the vibration unit to generate vibration to generate a corresponding sound wave after it is guided by the waveguide portion. Therefore, a better bass effect can be obtained.

The structure of the reflex enclosure of the present invention allows a rearward sound wave generated from a loudspeaker to be guide 360 degrees (in all directions) from the outside of a waveguide portion to the inside thereof in a sound room, capable of reducing a standing wave ratio of the rearward sound wave in the sound room to obtain a better sound quality. Furthermore, it can extend the length of a rearward sound wave guiding distance, allowing the sound wave to have the effect of extending toward low frequency compass, and the rearward sound wave to be compressed to increase a vibration unit pushing force, thereby improving a conventional reflex enclosure and obtaining a better sound effect.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A reflex enclosure, comprising:

an enclosure body; constituted by a first shell body and a second shell body, said first shell body being disposed with one first sound outlet, and said second shell body being disposed with at least one second sound outlet;

a loudspeaker, coupled to a position of said first shell body adjacent to said first sound outlet;

at least one waveguide portion constituted by a first waveguide element and a second waveguide element, said first waveguide element being constituted by a first bottom wall and a first surrounding wall, one end of said first surrounding wall being coupled to said first bottom wall, said second waveguide element being constituted by a second bottom wall and a second surrounding wall, one end of said second surrounding wall being coupled to said second bottom wall; said second bottom wall being disposed with an opening and a through hole communicating with an inside of said second surrounding wall, a diameter of said second surrounding wall being smaller than said first surrounding wall, said first surrounding wall being disposed at a periphery of said second surrounding wall, another end of said first surrounding wall not contacting with said second bottom wall, another end of said second surrounding wall not contacting with said first bottom wall; and at least one vibration unit, coupled to said second bottom wall shielding said opening and positioned adjacent to said second sound outlet, said second bottom wall being coupled to said second shell and positioned adjacent to said second sound outlet;

wherein, a hermetically sealed sound room is formed inside said enclosure body by coupling said loudspeaker, said waveguide portion and said vibration unit respectively to said enclosure body; when said loudspeaker generates a forward sound wave and a rearward sound wave, said forward sound wave propagates to an outside of said first shell body through said first sound outlet, and said rearward sound wave propagates in said sound room; from an outside of said first surrounding wall, said rearward sound wave is guided 360 degrees (in all directions) to bypass said first surrounding wall and said second surrounding wall, propagate to an inside of said second surrounding wall, and pass through said through hole to push said vibration unit to generate vibration to generate a corresponding sound wave, and said corresponding sound wave finally propagate to an outside of said second shell body through said second sound outlet.

2. The reflex enclosure according to claim 1, wherein said second bottom wall is disposed with a resonance chamber; said resonance chamber respectively communicates with said through hole and said opening.

3. The reflex enclosure according to claim 2, wherein said second shell body is optional to be disposed with one second sound outlet; said loudspeaker and said waveguide portion is arranged in a column; said first bottom wall is coupled to said loudspeaker or coupled to said enclosure body through a bracket.

4. The reflex enclosure according to claim 2 wherein said second shell body is optional to be disposed with two second sound outlets; said enclosure body is coupled to said two waveguide portions; said loudspeaker is disposed between said two waveguide portions; said first waveguide element is integrated with said first shell body or coupled to said first shell body.

5. The reflex enclosure according to claim 2, wherein said resonance chamber is a horn-shaped body.

6. The reflex enclosure according to claim 5, wherein said first surrounding wall is disposed at a periphery of said second surrounding wall with an equal space around.

7. The reflex enclosure according to claim 6, wherein said second shell body is optional to be disposed with one second sound outlet; said loudspeaker and said waveguide portion is arranged in a column; said first bottom wall is coupled to said loudspeaker or coupled to said enclosure body through a bracket.

8. The reflex enclosure according to claim 6, wherein said second shell body is optional to be disposed with two second sound outlets; said enclosure body is coupled to said two waveguide portions; said loudspeaker is disposed between said two waveguide portions; said first waveguide element is integrated with said first shell body or coupled to said first shell body.

9. The reflex enclosure according to claim 6, wherein said first waveguide element further comprises a third surrounding wall, said second waveguide element further comprises a fourth surrounding wall, a diameter of said second surrounding wall is smaller than said third surrounding wall, a diameter of said fourth surrounding wall is smaller than said first surrounding wall but larger than said third surrounding wall, said third surrounding wall, said fourth surrounding wall and said first surrounding wall are disposed at a periphery of said second surrounding wall in sequence, said third surrounding wall does not contact with said second bottom wall, said fourth surrounding wall does not contact with said first bottom wall, said rearward sound wave bypasses said first surrounding wall, said fourth surrounding wall, said third surrounding wall and said second surrounding wall in sequence to propagate to said inside of said second surrounding wall.

10. The reflex enclosure according to claim 9, wherein said second shell body is optional to be disposed with one second sound outlet; said loudspeaker and said waveguide portion is arranged in a column; said first bottom wall is coupled to said loudspeaker or coupled to said enclosure body through a bracket.

11. The reflex enclosure according to claim 9, wherein said second shell body is optional to be disposed with two second sound outlets; said enclosure body is coupled to said two waveguide portions; said loudspeaker is disposed between said two waveguide portions; said first waveguide element is integrated with said first shell body or coupled to said first shell body.

12. The reflex enclosure according to claim 9, wherein said third surrounding wall, said fourth surrounding wall and said first surrounding wall is equidistantly disposed at said periphery of said second surrounding wall in sequence.

13. The reflex enclosure according to claim 12, wherein said second shell body is optional to be disposed with one second sound outlet; said loudspeaker and said waveguide portion is arranged in a column; said first bottom wall is coupled to said loudspeaker or coupled to said enclosure body through a bracket.

14. The reflex enclosure according to claim 12 wherein said second shell body is optional to be disposed with two second sound outlets; said enclosure body is coupled to said two waveguide portions; said loudspeaker is disposed between said two waveguide portions; said first waveguide element is integrated with said first shell body or coupled to said first shell body.

15. The reflex enclosure according to claim 12, wherein positions of said first bottom wall adjacent to said second surrounding wall and said fourth surrounding wall respectively have a curved shape projected toward said first sound outlet.

16. The reflex enclosure according to claim 15, wherein said second shell body is optional to be disposed with one second sound outlet; said loudspeaker and said waveguide portion is arranged in a column; said first bottom wall is coupled to said loudspeaker or coupled to said enclosure body through a bracket.

17. The reflex enclosure according to claim 15, wherein said second shell body is optional to be disposed with two second sound outlets; said enclosure body is coupled to said two waveguide portions; said loudspeaker is disposed between said two waveguide portions; said first waveguide element is integrated with said first shell body or coupled to said first shell body.

18. The reflex enclosure according to claim 1, wherein said second shell body is optional to be disposed with one second sound outlet; said loudspeaker and said waveguide portion is arranged in a column; said first bottom wall is coupled to said loudspeaker or coupled to said enclosure body through a bracket.

19. The reflex enclosure according to claim 1, wherein said second shell body is optional to be disposed with two second sound outlets; said enclosure body is coupled to said two waveguide portions; said loudspeaker is disposed between said two waveguide portions; said first waveguide element is integrated with said first shell body or coupled to said first shell body.

* * * * *